US006365883B1

(12) United States Patent
Pohl

(10) Patent No.: US 6,365,883 B1
(45) Date of Patent: Apr. 2, 2002

(54) U-SHAPED ADHESIVE BONDING APPARATUS

(75) Inventor: Gregory L. Pohl, Sterling Heights, MI (US)

(73) Assignee: Robotron Corporation, Southfield, MI (US)

( * ) Notice: Subject to any disclaimer, the term of this patent is extended or adjusted under 35 U.S.C. 154(b) by 0 days.

(21) Appl. No.: 09/388,433

(22) Filed: Sep. 2, 1999

Related U.S. Application Data

(60) Provisional application No. 60/099,916, filed on Sep. 11, 1998.

(51) Int. Cl.[7] ..... H05B 6/36

(52) U.S. Cl. ..... 219/634; 219/603; 219/633; 219/673; 219/675

(58) Field of Search ..... 219/633, 673, 219/676, 672, 677, 634, 602, 603, 615, 617, 635, 675; 156/380.2

(56) References Cited

U.S. PATENT DOCUMENTS

| | | | | |
|---|---|---|---|---|
| 2,797,288 A | | 6/1957 | Kiemele et al. | |
| 3,230,337 A | * | 1/1966 | Viart | 219/673 |
| 3,251,976 A | | 5/1966 | McBrien | |
| 3,395,261 A | * | 7/1968 | Leatherman et al. | 219/672 |
| 3,725,630 A | | 4/1973 | Gagliardi | |
| 3,737,613 A | * | 6/1973 | Gillock | 219/673 |
| 3,738,892 A | | 6/1973 | Curcio | |
| 3,766,353 A | * | 10/1973 | Barbieux | 219/675 |
| 3,800,115 A | * | 3/1974 | Cachat | 219/672 |
| 4,197,441 A | * | 4/1980 | Rudd | 219/672 |
| 4,251,704 A | | 2/1981 | Masie et al. | |
| 4,251,707 A | | 2/1981 | Pusateri et al. | |
| 4,252,585 A | | 2/1981 | Raabe et al. | |
| 4,293,363 A | | 10/1981 | Wakabayashi et al. | |
| 4,363,946 A | | 12/1982 | Busemann | |
| 4,602,139 A | | 7/1986 | Hutton et al. | |
| 4,820,892 A | * | 4/1989 | Holmstrom et al. | 219/674 |
| 4,950,348 A | | 8/1990 | Larsen | |
| 4,969,968 A | | 11/1990 | Leatherman | |
| 5,001,319 A | | 3/1991 | Holmstrom | |
| 5,048,260 A | | 9/1991 | Raymond et al. | |
| 5,129,977 A | | 7/1992 | Leatherman | |
| 5,260,535 A | | 11/1993 | Holmstrom et al. | |
| 5,317,121 A | * | 5/1994 | Katayama et al. | 219/672 |
| 5,365,041 A | | 11/1994 | Shank | |
| 5,374,809 A | * | 12/1994 | Fox et al. | 219/633 |
| 5,442,159 A | | 8/1995 | Shank | |
| 5,495,094 A | * | 2/1996 | Rowan et al. | 219/645 |

FOREIGN PATENT DOCUMENTS

| | | |
|---|---|---|
| DE | 40 21 025 | 7/1990 |
| EP | 0589087 A1 | 3/1994 |
| GB | 1220995 | 1/1971 |
| GB | 1372318 A | 10/1974 |
| GB | 1374018 A | 11/1974 |
| JP | 64 51294 | 3/1989 |
| JP | 1-275744 | 11/1989 |
| JP | 010275744 A | 11/1989 |
| JP | 2 123093 | 10/1990 |
| JP | 6-188068 | 7/1994 |
| JP | 0160188068 A | 7/1994 |
| JP | 11-192562 | 7/1999 |
| JP | 110192562 A | 7/1999 |

* cited by examiner

*Primary Examiner*—Tu Ba Hoang
(74) *Attorney, Agent, or Firm*—Young & Basile, P.C.

(57) ABSTRACT

An induction heating coil for joining structural members by heating a bonding material disposed between the structural members includes first and second elements with complementary shapes spaced equidistantly apart along the length of opposing surfaces of the structural members. Bases and risers connected to the first element to a source of high frequency electrical current. Conductive elements connect the first and second elements into a single turn coil. The first and second elements, and at least the riser, are formed of hollow, tubular members to form a coolant flow path therethrough.

13 Claims, 3 Drawing Sheets

U-SHAPED ADHESIVE BONDING APPARATUS

CROSS REFERENCE TO CO-PENDING APPLICATION

This application claims the benefit of the filing date of co-pending Provisional Application Ser. No. 60/099,916, filed Sep. 11, 1998, the entire contents of which are incorporated herein by reference.

BACKGROUND OF THE INVENTION

1. Field of the Invention

The present invention relates, generally, to apparatus for joining two structural sheets by heating a bonding material disposed between the juxtaposed edges of two metal sheets and, more specifically, to electrical heating apparatus for heating a bonding material to join two sheets together.

2. Description of the Art

The use of a heat curable, adhesive bonding material to join two juxtaposed structural elements or metal sheets is widely used in the automotive industry. Such a bonding technique is employed for doors, deck lids, hoods and like assemblies in which two metal sheets or panels are arranged in an edge overlapping manner with a suitable bonding material placed between the two sheets before the edge of one sheet is hemmed over the adjacent edge of the other sheet. Heat is then applied to the bonding material to cure the material and form a high-strength joint between the two structural elements or sheets.

It is well-known that the assembly of automotive vehicles involves high production rates. As such, electric induction coils have been employed to provide the necessary heat to quickly cure the bonding material. Such induction coils carry a high frequency electrical current which generates a magnetic field and causes heating of the metal sheets, which heat is conducted to and cures the bonding material disposed between the two sheets. Since the hemmed perimeter areas of doors, deck lids, hoods and the like can be quite large, it is common to employ such induction coils at only selected locations along the length of any hem so as to spot cure the bonding material only at the locations of the induction coils. The remainder of the bonding material is cured at a later time during the assembly process, such as when the automotive vehicle passes through a paint oven. It is also known to use induction coils around the entire perimeter edge or edges of an assembly to cure all of the bonding material at one time.

A typical prior art induction coil for bonding applications is shown in FIG. 1. In this typical arrangement, an induction coil 10 is positioned below an insulating material support 12. The support 12 receives and supports a hemmed edge 13 of an outer sheet or panel 14 and an inner sheet or panel 16. A strip of adhesive bonding material 18 is disposed between the outer and inner sheets 14 and 16 prior to the hemming operation. The passage of a high frequency electrical current through the induction coil 10 generates a magnetic field which induces heat in the metal sheets 14 and 16, which heat is conducted to and cures the bonding material 18 in the area of the induction coil 10.

FIG. 2 depicts another typical induction coil which is described in greater detail in U.S. Pat. No. 4,950,348. The induction coil 20 includes a generally rectangular-shaped coil assembly having a pair of outwardly extending legs 22, only one being shown in FIG. 2, which are connected to a source of electrical power, such as a transformer, not shown.

A riser 24 and mounting base 26 are connected to the coil 20 to provide a suitable mount for the coil 20. Cores 28 are disposed about selected portions of the coil 20 for concentrating the magnetic field generated by the coil 20. In use, the prior art coil 20, shown in FIG. 2, is disposed on only one side of a hem joint between two overlapping sheets, such as the sheets 14 and 16 shown in FIG. 1.

The use of a single induction coil, as shown in the prior art arrangements of FIGS. 1 and 2, requires long heating times to cure the bonding material to a sufficient strength. Further, since the single induction coil is located on only one side of the hemmed joint of two sheets, more heat is generated at one sheet than on the other sheet resulting in an uneven heating of the bonding material.

FIG. 3 depicts yet another prior art induction coil used in bonding applications. In this arrangement, which is described in greater detail in U.S. Pat. No. 4,602,139, a lower fixture 30 attached to any suitable tool or support, not shown, carries a first or lower induction coil 32 which is mounted in a block of electrically insulating material 34. The lower fixture 30 also supports the hemmed joint formed between a lower outer sheet 36 and an inner disposed upper sheet 38, with a strip of adhesive bonding material 40 disposed therebetween. An upper fixture 42 supports a second or upper induction coil 44 which is also mounted in a block of electrical insulating material 46 in the upper fixture 42. The upper fixture 42 and the lower fixture 30 are movable with respect to each other so as to be separated from each other to permit the mounting or removal of the hemmed sheets 36 and 38 between the two fixtures.

In one mode of operation, the upper fixture 42 is lowered over the hemmed sheets 36 and 38 to place the second induction coil 44 above one surface of the hemmed edge of the sheets 36 and 38. The first or lower induction coil 32 is positioned substantially in line with the second coil 44, but is located below the hemmed edges of the sheets 36 and 38. The use of two induction coils 32 and 44 on opposite sides of the hemmed joint of the sheets 36 and 38 creates a more even heating of the bonding material 40 since heat is applied to the sheets 36 and 38 from both sides at the same time. However, the design of the tooling in this arrangement is more complicated since at least one of the fixtures, such as the upper fixture 42, must be movable with respect to the other fixture to permit the mounting and removal of the hemmed sheets 36 and 38 therebetween.

U.S. Pat. Nos. 5,365,041 and 5,442,159, assigned to the Assignee of the present invention, disclose an apparatus and method for heating adhesively bonded metal sheets utilizing an L-shaped coil. The L-shaped coil has a first leg which is disposed underneath the hemmed metal sheet joint and a perpendicular second leg located adjacent to the side edge of the hemmed joint in close proximity to the outer surface of the upper metal sheet.

This L-shaped coil, as compared to single side heating, causes the temperature of the upper sheet to more closely approximate that of the lower sheet. The temperature of the lower sheet is slightly hotter than the upper sheet due to the first coil leg being disposed in near proximity to the lower sheet; while the upper sheet is primarily influenced by the second leg of the coil which is not in as near proximity to the upper sheet as the first coil leg is to the lower sheet. Although the upper surface temperature is cooler than that of the lower sheet, the temperature difference between the two sheets is less than that obtained with single side heating thereby providing a better adhesive bond.

However, if the joined sheets have a lower surface which is convex, as it typical in an automotive body panel, the inclusive angle between the first and second legs of the coil must be greater than the preferred 90° to facilitate loading of the panel onto the fixed coils. This inclusive angle adversely increases the temperature difference between the lower and upper sheets.

Thus, it would be desirable to provide a novel induction bonding apparatus and method which cures a bonding material to a higher strength than in prior art bonding apparatus. It would also be desirable to provide an induction bonding apparatus and method which creates a high strength, cured bond between two sheets or panels in less time than with previously devised heating apparatus for bonding applications. It would also be desirable to provide an induction bonding apparatus and method which uniformly heats both of the upper and lower surfaces of a hemmed adhesive joint.

SUMMARY OF THE INVENTION

The present invention is an induction heating coil for curing a bonding material disposed between overlapped or hemmed portions of two structural members or metal sheets by heating the bonding material to a cured state.

In one aspect of the invention, the induction heating coil includes a first element formed of a first inductive heating surface adapted to be disposed adjacent to one of the two metal sheets and the bonding material disposed therebetween, and a second element having a shape complementary to the shape of the first element and spaced from the first element. The second element forms a second inductive heating surface adapted to be disposed adjacent to an opposite one of the two structural members or metal sheets and the bonding material disposed therebetween.

In the invention, the second element is preferably equally spaced from the first element along the length of both of the first and second elements. Preferably, the first and second elements are parallel. In one aspect, the first and second elements are spaced in parallel planes.

The first and second elements may have any shape, including a straight shape between opposed ends or a curved shape, such a convex or concave shape in one plane, between opposed ends. This enables the first and second elements to follow the peripheral edge of an irregularly shaped hemmed structural assembly.

In one aspect of the invention, conductive elements connect the first and second elements into a single turn coil. Preferably, the conductive elements comprise first and second end legs which are respectively joined to first and second end-to-end legs forming the first element. Third and fourth end legs are connected to opposed ends of the second element. The first, second, third, and fourth end legs are electrically connected, such as by interconnecting legs.

First and second spaced risers are connected to and extend from the first and second legs of the first element. First and second base members are connected to the first and second risers, respectively, for connecting the first element to a source of high frequency electrical current.

In one aspect of the invention, the first and second risers, the first and second legs of the first element and the first and second end legs are coplanar. Likewise, the third and fourth end legs and the second element are coplanar with each other.

Coolant flow paths are formed in the first and second elements, including the first and second risers, the first, second, third, and fourth end legs and the interconnecting legs between the first, second, third, and fourth end legs. The coolant flow paths are preferably formed by constructing the first and second elements, the risers and the end legs of hollow, tubular members.

Magnetic field concentrating members may be disposed about the first and second elements for concentrating the magnetic field generated by the first and second elements through the structural members or metal sheets disposed between the first and second elements.

The induction coil of the present invention provides advantages over previously devised induction coils used to cure a bonding material between two overlapped or hemmed structural members or metal sheets. The essentially parallel arrangement of the first and second elements of the present induction coil which are connected as a single turn coil may be configured in a variety of shapes to follow the shape of the peripheral edge of the structural members or metal sheets disposed therebetween. Thus, while the first and second elements are preferably parallel and spaced equidistantly from each other between opposed ends, the first and second elements may take any linear or non-linear, irregular shape between the opposed ends to closely follow the shape of the peripheral or hemmed edge of the structural members or metal sheets disposed therebetween; while at the same time providing uniform heating of both of the upper and lower surfaces of the hemmed joint between the structural members or metal sheets.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENTS

Figure 4:
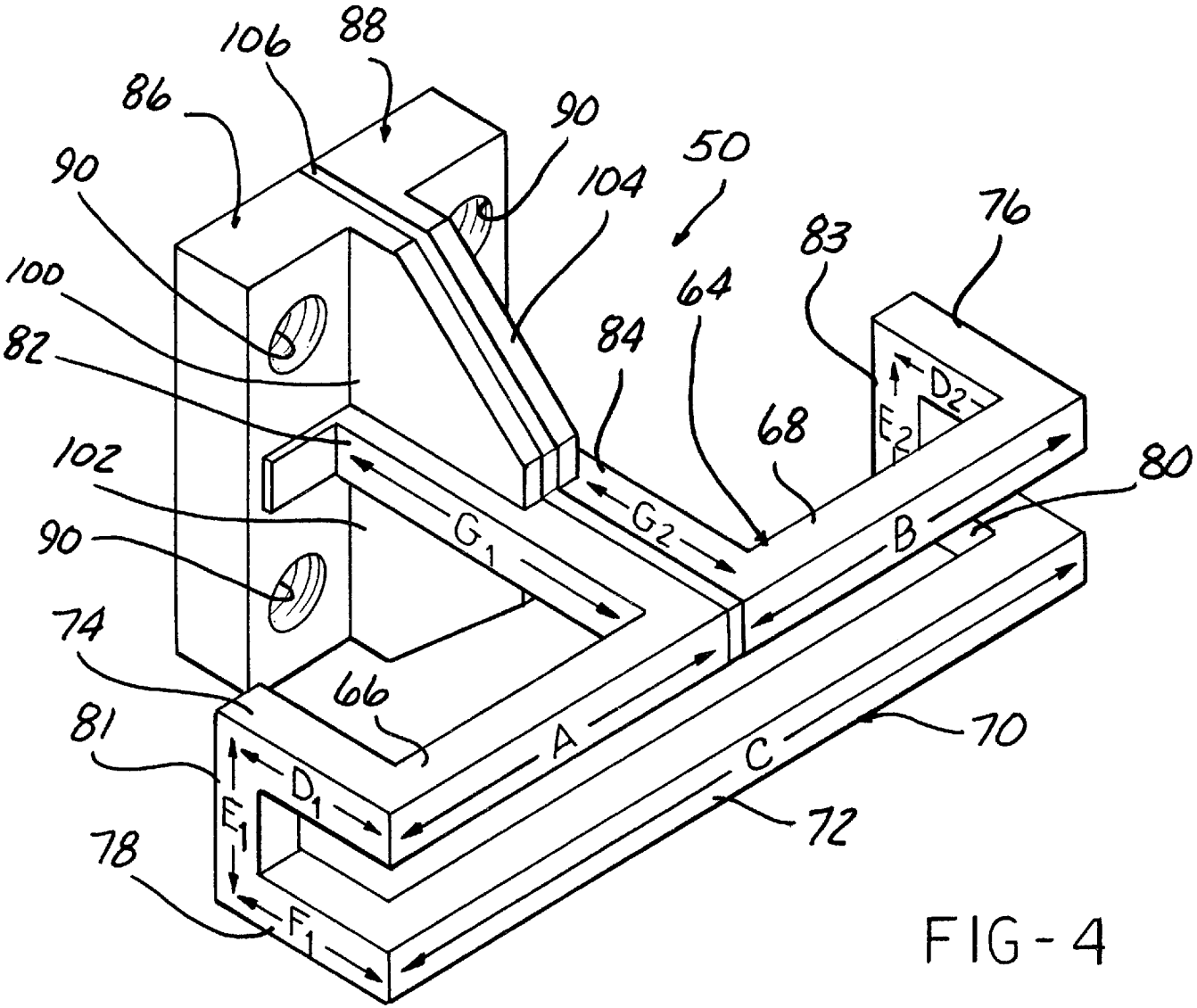
FIG. 4 is a perspective view of a preferred embodiment of the induction coil of the present invention.
Figure 5:
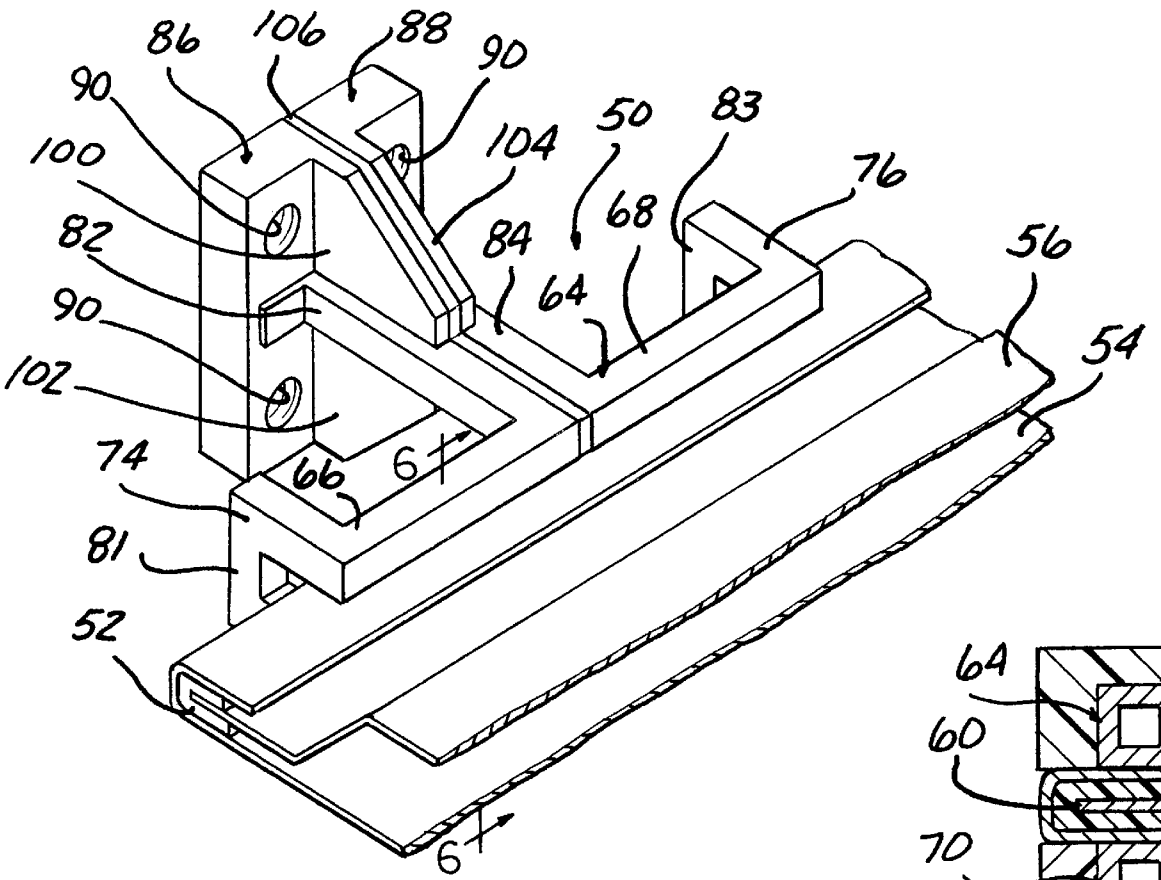
FIG. 5 is a perspective view of the induction coil shown in FIG. 4 with a workpiece installed.
Figure 6:
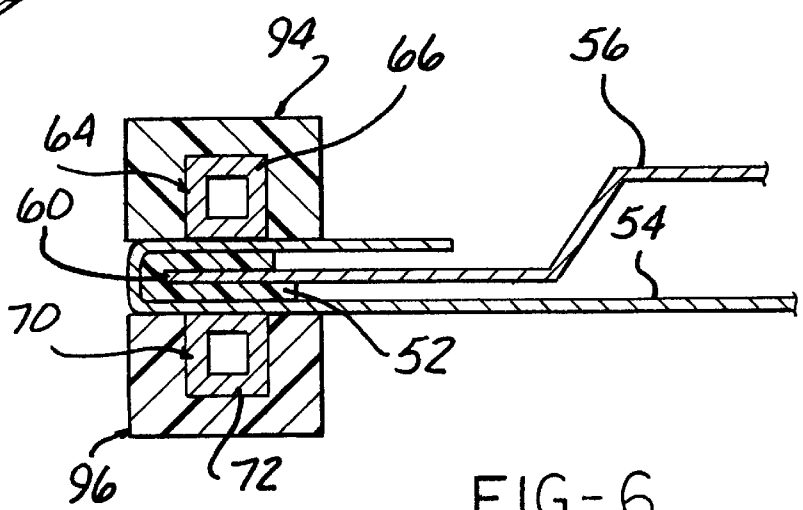
FIG. 6 is a cross-sectional view generally taken along line 6—6 and FIG. 5 with optional concentrating magnetic cores added.

Referring now to FIGS. 4–6, there is depicted a preferred embodiment of an electric induction heating coil 50 according to the present invention. The induction coil 50 is devised to heat a strip, bead or spot of adhesive bonding material 52 disposed between a juxtaposed arrangement of outer structural element or metal sheet 54 and an inner structural element or metal sheet 56. As shown in FIGS. 5 and 6, the outer edge 58 of the lower sheet 54 is hemmed around the outer edge 60 of the inner sheet 56. Prior to the hemming operation, the strip, bead or spot 52 of bonding material is applied to one surface of the lower sheet 54, with the edge 60 of the inner sheet 56 then brought into contact therewith. During the hemming of the outer edge 58 of the lower sheet 54 about the edge 60 of the inner sheet 56, portions of the bonding material 52 will be squeezed around the side edge 60 of the inner sheet 56 and onto the opposed surface of the inner sheet 56 between the inner sheet 56 and the outer edge 58 of the outer sheet 54.

In a preferred embodiment, the induction coil 50 includes a first element 64 having first and second, co-linear leg portions 66 and 68. The first and second leg portions 66 and 68 are arranged in a straight line and spaced apart by a small distance, as shown in FIGS. 4–6.

The induction coil 50 also includes a second element 70 formed of a second leg 72. The second element 70 is disposed at a predetermined, spacing from the first element 64 suitable for slidably receiving or to be inserted over the hemmed joint between the metal sheets 54 and 56 as shown in FIG. 6. This enables the first element 64 to be disposed adjacent one surface of the hem between the two sheets 54 and 56; while the second element 70 is disposed adjacent to the edge of the hemmed joint of the two sheets 54 and 56.

The first and second elements 64 and 70 are provided in any desired length for spot bonding of a small length of the bonding material 52 or for bonding the entire peripheral edge of an assembly.

The first and second legs 66 and 68 of the first element 64 form or lie in a first plane as shown in FIG. 4. The second element 70 is spaced from the first element 64 and is preferably parallel to the first element 64. It can be said that the second element 70 lies in a second plane parallel to the first plane.

Further, the outer edges of the first and second elements 64 and 70, as shown in FIG. 6, are preferably co-planar with each other. It will be understand, however, that the outer edges of the first and second elements 64 and 70 may be offset to meet the needs of a particular application without detracting from the teachings of the present invention.

Means are provided for joining the first and second elements 64 and 70 into a single turn induction coil. The joining means preferably comprises first and second end legs 74 and 76 which are integrally formed with or joined to the first and second leg portions 66 and 68, respectively, of the first element 64. The first and second end legs 74 and 76 are preferably brazed to one end of the first and second leg portions 66 and 68, respectively. The first and second end legs 74 and 76 lie in the same first plane as the first and second leg portions 66 and 68 of the first element 64.

Third and fourth end legs 78 and 80, respectively, are integrally formed with or joined to the leg 72 of the second element 70. In an exemplary embodiment, the third and fourth end legs 78 and 80 are brazed to opposite ends of the leg 72 forming the second element 70 and lie in the same second plane as the second element 70.

Fifth and sixth end legs 81 and 83, respectively, are integrally formed with or joined to one end of the first and third legs 74 and 78, respectively, and the second and sixth legs 76 and 80, respectively. As shown in FIG. 4, this arrangement forms a U-shaped, single turn induction coil between the first and second elements 64 and 70 which is suited for easily receiving the hemmed joint of the two metal sheets 54 and 56 in close proximity therebetween as shown FIG. 6.

In an exemplary construction, riser means in the form of first and second risers 82 and 84 are joined to the first and second leg portions 66 and 68, respectively, of the first element 64 and extend substantially perpendicularly therefrom. The first and second risers 82 and 84 are connected to or integrally formed with first and second base members 86 and 88, respectively, which form a base means for connecting the induction coil 50 to a source of high frequency, electrical current, such as a conventional transformer, electric bus bars, etc., not shown. Mounting apertures 90 are formed in the first and second base members 86 and 88 to receive fasteners to mount the induction coil 50 to the source of electrical current.

Ribs 100 and 102 are integrally formed with and extend between the first base member 86 and opposite sides of the first riser member 82, as shown in FIGS. 4 and 5. A similar pair of ribs 104 are also provided between the second base member 88 and opposite sides of the second riser 84. In addition, a layer of electrical insulating material 106, such as a plastic, is disposed between the spaced portions of the ribs 100, 102 and 104, the first and second risers 82 and 84, and the facing ends of the first and second legs 66 and 68 of the first element 64 to provide electrical insulation between such elements.

All of the component parts of the first and second elements 64 and 70, as well as the first and second risers 82 and 84 and the first and second base members 86 and 88, are preferably formed of an electrically conductive material, such as copper. Further, all of the components of the first and second elements 64 and 70 and the first and second risers 82 and 84 are formed as hollow, tubular members having an internal passage denoted generally by reference number 92 in FIG. 6 extending therethrough. The passage 92 opens through each of the base members 86 and 88 and extends through the entire induction coil 50 to provide a coolant fluid flow path when the ends of the passage 92 in the base members 86 and 88 are connected to a source of coolant fluid. The flow of coolant fluid through the induction coil 50 removes heat from the induction coil 50.

The integral connection of the first and second elements 64 and 70 by the respective first and second end legs 74 and 76, the third and fourth end legs 78 and 80, and the fifth and sixth end legs 81 and 83 forms a single turn induction coil which generates a magnetic field about the elements 64 and 70 and coupled into the metal sheets 54 and 56 when a high frequency electrical current is passed therethrough. The magnetic field causes heating of the metal sheets 54 and 56 in the areas of the first and second elements 64 and 70 which heat is conducted through the sheets 54 and 56 to the bonding material 52 disposed therebetween. The application of heat for a predetermined amount of time partially or fully cures the bonding material 52 at least in the proximity of the induction coil 50.

Due to the spaced parallel arrangement of the first and second elements 64 and 70 of the induction coil 50 which follows the shape of the hemmed joint, curing of the bonding material 52 to a solid, high strength state is achieved much quicker than in previously devised single induction coil apparatus for spot bonding applications since uniform amounts of heat are applied from the bottom surface of the hemmed joint and from the top surface. The heat is conducted by the sheets 54 and 56 to the bonding material to heat any bonding material disposed above the inner sheet 56 and the overlapped outer edge 58 of the outer sheet 54. Thus, heating of the bonding material 52 occurs simultaneously on both sides of the sheet 56 thereby substantially reducing the time required to cure the bonding material to a high strength state.

Figure 1:
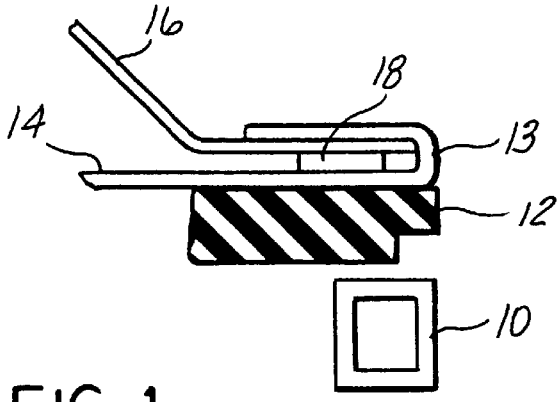
FIG-1 PRIOR ART
FIG. 1 is a side elevational view of a first prior art induction coil for spot bonding applications.
Figure 2:
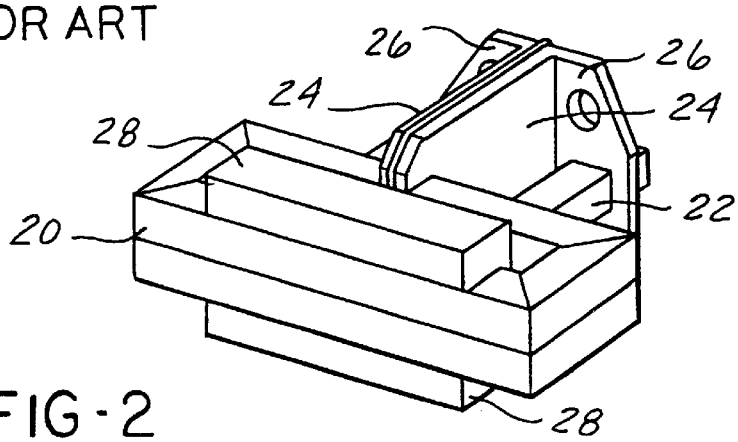
FIG-2 PRIOR ART
FIG. 2 is a perspective view of a second prior art induction coil for spot bonding applications.
Figure 3:
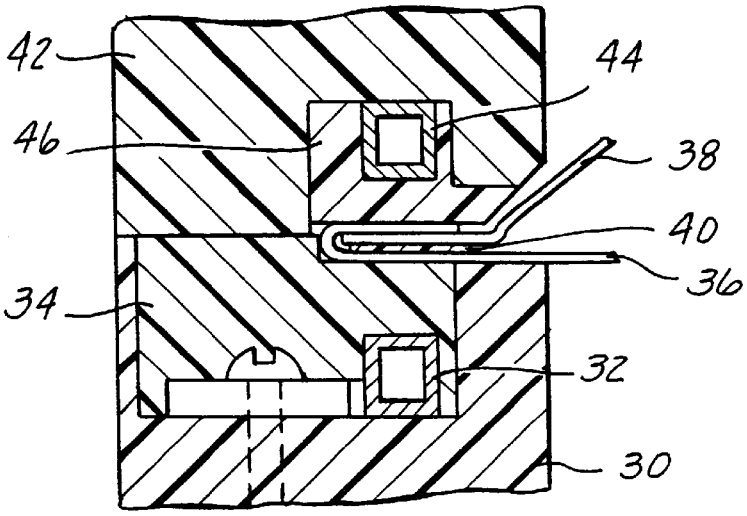
FIG-3 PRIOR ART
FIG. 3 is a cross-sectional, side view of a third prior art induction coil having an opposed, spaced pair of induction coils.

For example, electrical current at frequencies of between 3 to 30 kHz through the induction coil 50 can generate temperatures of between 250° to 450° in the bonding material 52. Depending on the amount of heating time and the resulting cure temperature at the sheets 54 and 56, the U-shaped induction coil 50 of the present invention can provide an increase in cure strength of the bonding material 52 over the single coil apparatus shown in FIGS. 1 and 2.

Concentrating magnetic cores may optionally be provided about predetermined portions of the first and second elements 64 and 70 for concentrating the magnetic field generated by the first and second elements 64 and 70. By way of example, first and second U-shaped magnetic cores 94 shown in FIG. 6 are mounted about and joined to each of the first and second leg portions 66 and 68 of the first element 64. Similarly, an elongated U-shaped magnetic core 96 is disposed about the leg 72 of the second element 70. The magnetic cores may be formed of magnetic laminations or other magnetic materials to effectively shorten the magnetic path about the conductive first and second elements 64 and 70 on those surfaces not facing the workpiece or metal sheet 54. Providing such magnetic cores 94 and 96 increases the magnetic coupling efficiency and therefore the energy transfer efficiency of the induction coil 50.

Finally, the induction coil 50 is provided with protective elements, not shown, which are fixedly attached to or disposed on the first element 64 and the second element 70 and provide a suitable protective surface which prevents contact of the outer surface of the hemmed sheets 54 and 56 with the first and second elements 64 and 70.

The induction coil 50 is well suited for robotic material handling applications. In one application, a nesting table is not used to hold the workpiece during the curing process; but, rather, the workpiece is held by a robotic arm and the coil 50 disposed in a fixed position. The robotic arm is used to repeatedly locate selected sections of the panel in the induction coil 50 during curing. In a second application, the induction coil 50 is fixed to the end of a robotic arm and the workpiece is held in a fixture. The robotic arm is used to repeatedly locate the coil 50 on selected sections of the panel or workpiece for curing. In both of the above-described robotic handling applications, the U-shaped induction coil 50 of the present invention offers better temperature uniformity without penalizing automation costs when compared to prior induction coil designs.

In use, a strip of bonding material 52 will be initially applied to the outer panel 54 at a location spaced from the perimeter edge 58 of the outer panel 54. The inner panel 56 is then brought into a juxtaposed position with respect to the outer panel 54 and contacts the strip of bonding material 52. The outer edge 58 of the outer sheet 54 is then bent or hemmed around the outer edge 60 of the inner sheet 56 to create a hem joining the two sheets 54 and 56 together and squeezing the bonding material to the opposite side of the sheet 56. The hemmed joint is then disposed in proximity with the induction coil 50 as described above. With coolant fluid flowing through the internal passage 92 in induction coil 50, a high frequency current is applied to the induction coil 50. This current induces a magnetic field which causes heating of the metal panels 54 and 56 in locations immediately adjacent the first and second elements 64 and 70 of the induction coil 50. Such heat is conducted to the bonding material 50 and cures the bonding material 52 to a high strength solid state thereby joining the two sheets 54 and 56 solidly together. The joined first and second sheets 54 and 56 are then removed from the induction coil 50.

The first and second elements 64 and 70 are mechanically joined together by the first through the sixth legs 74, 76, 78, 80, 81 and 83 such that the physical relationship or spacing between the first and second elements remains fixed at all times. In this manner, any mechanical means used to move the induction coil 50 moves both of the first and second elements 64 and 70 simultaneously.

In certain applications, the contour of the workpiece or metal sheets 54 and 56 may take an irregular, non-linear shape, such as a convex or concave shape at the hem joint. It will understood that the first and second elements 64 and 70 of the induction 50 of the present invention may be formed with a complimentary non-linear, irregular surfaces, such as arcuate concave or convex surfaces of a complimentary, opposed nature so to removably conform to the shape of the hemmed joint.

In summary, there has been disclosed an induction heating coil for bonding juxtaposed portions of metal sheets together by a heat curable bonding material. The induction heating coil includes first and second spaced electrically conductive elements having complimentary shapes for receiving the juxtaposed portions of the metal sheets therebetween. Means are provided for supplying a high frequency electric current to the first and second elements.

What is claimed is:

1. An induction heating coil for inductively heating juxtaposed portions of at least two metal sheets to cure a heat curable bonding material disposed between the at least two metal sheets to bond the two metal sheets together, the induction heating coil comprising:

a first element forming a first inductive heating surface adapted to be disposed adjacent to one of the at least two metal sheets and the bonding material disposed therebetween;

a second element having a shape complementary to the shape of the first element and spaced from the first element, the second element forming a second inductive heating surface adapted to be disposed adjacent to another one of the at least two metal sheets and the bonding material disposed therebetween and co-extensive with the first element;

conductive elements interconnected between co-extensive ends of the first and second elements and connecting the first and second elements into a single turn coil, the conductive elements, the first element and the second element defining an opening between the first and second elements and along an axis extending through the ends and between the first and second elements adapted for receiving edge portions of the at least two metal sheets in magnetic coupling relationship with the first and second elements; and means for supplying a high frequency electrical current to the first and second elements and the conductive elements.

2. The induction heating coil of claim 1 wherein:

the second element is equally spaced from the first element along the entire length of the first and second elements.

3. The induction heating coil of claim 1 wherein:

the first and second elements are disposed in parallel.

4. The induction heating coil of claim 1 wherein:

each of the first and second elements are planar between opposed ends.

5. The induction heating coil of claim 1 wherein the first element comprises:

first and second end-to-end arranged legs.

6. The induction heating coil of claim 2 wherein the conductive elements comprise:

first and second end legs respectively extending from each of the first and second legs of the first element;

third and fourth end legs respectively extending from opposite ends of the second element; and the first and second end legs electrically connected to the third and fourth end legs.

7. The induction heating coil of claim 6 wherein:

the first and second end legs are coplanar with the first and second legs; and the third and fourth legs are coplanar with the second element.

8. An induction heating coil for inductively heating juxtaposed portions of at least two metal sheets to cure a heat curable bonding material disposed between the at least two metal sheets to bond the two metal sheets together, the induction heating coil comprising:

a first element forming a first inductive heating surface adapted to be disposed adjacent to one of the two metal sheets and the bonding material disposed therebetween, the first element including first and second legs;

a second element having a shape complementary to the shape of the first element and spaced from the first element, the second element forming a second inductive heating surface adapted to be disposed adjacent to another one of the two metal sheets and the bonding material disposed therebetween;

conductive elements interconnected between co-extensive ends of the first and second elements and connecting the first and second elements into a single turn coil, the conductive elements including:

first and second end legs respectively extending from each of the first and second legs of the first element;

third and fourth end legs respectively extending from opposite ends of the second element;

the first and second end legs electrically connected to the third and fourth end legs;

first and second spaced risers connected to and extending from the first and second legs;

first and second base members connected to the first and second risers, respectively, and wherein:

the conductive elements, the first element and the second element defining an opening between the first and second elements and along an axis extending through the ends and between the first and second elements adapted for receiving edge portions of the at least two metal sheets in magnetic coupling relationship with the first and second elements.

9. The induction heating coil of claim 8 wherein:

the first and second risers are coplanar with the first and second legs of the first element.

10. The induction heating coil of claim 8 further comprising:

insulation members disposed between the first and second risers, and the first and second base members.

11. The induction heating coil of claim 1 further comprising:

a fluid flow path formed in the first and second elements for flow of coolant fluid through the first and second elements.

12. The induction heating coil of claim 11 wherein the first and second elements are constructed of hollow, tubular members.

13. The induction heating coil of claim 1 further comprising:

magnetic cores encircling portions of the first and second elements for concentrating the magnetic field generated by the first and second elements.

* * * * *